US007908966B2

(12) United States Patent
Sieber et al.

(10) Patent No.: US 7,908,966 B2
(45) Date of Patent: Mar. 22, 2011

(54) CYLINDER OF AN INKING OR DAMPENING SYSTEM

(75) Inventors: Jochen Sieber, Eichelsee (DE); Andreas Ewald Heinrich Bernard, Sulzfeld (DE); Manfred Herrmann Liebler, Erlenbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 893 days.

(21) Appl. No.: 10/564,011

(22) PCT Filed: Jul. 7, 2004

(86) PCT No.: PCT/EP2004/051378

§ 371 (c)(1),
(2), (4) Date: Aug. 21, 2006

(87) PCT Pub. No.: WO2005/007410

PCT Pub. Date: Jan. 27, 2005

(65) Prior Publication Data

US 2007/0039496 A1 Feb. 22, 2007

(30) Foreign Application Priority Data

Jul. 11, 2003 (DE) ..... 103 31 595
Nov. 11, 2003 (DE) ..... 103 52 614

(51) Int. Cl.
*B41F 31/15* (2006.01)
*B41F 31/30* (2006.01)

(52) U.S. Cl. ..... 101/352.04; 101/148; 101/209; 101/218; 101/247; 101/351.3; 101/352.09; 101/DIG. 35; 101/DIG. 38

(58) Field of Classification Search ..... 101/348, 101/DIG. 32
See application file for complete search history.

(56) References Cited

U.S. PATENT DOCUMENTS

| | | | | |
|---|---|---|---|---|
| 4,050,383 | A * | 9/1977 | Hynst | 101/DIG. 32 |
| 4,130,057 | A * | 12/1978 | List et al. | 101/148 |
| 4,481,882 | A * | 11/1984 | Rudolph | 101/148 |
| 4,646,638 | A * | 3/1987 | Theilacker | 101/DIG. 38 |
| 4,729,309 | A | 3/1988 | Saterini et al. | |
| 4,841,855 | A | 6/1989 | Marcum | |
| 4,960,052 | A | 10/1990 | Junghans | |
| 5,025,724 | A | 6/1991 | Holl et al. | |
| 5,142,977 | A | 9/1992 | Gertsch et al. | |
| 5,429,050 | A * | 7/1995 | Palmcrantz | 101/348 |
| 5,676,057 | A * | 10/1997 | Hummel et al. | 101/351.1 |
| 5,690,029 | A | 11/1997 | Herrmann et al. | |
| 5,826,508 | A * | 10/1998 | Komori | 101/DIG. 32 |
| 5,907,999 | A | 6/1999 | Lusar et al. | |
| 6,109,177 | A | 8/2000 | Wech et al. | |
| 6,408,748 | B1 | 6/2002 | Hajek et al. | |
| 6,546,865 | B2 * | 4/2003 | Fischer et al. | 101/DIG. 38 |
| 6,612,238 | B2 | 9/2003 | Voge et al. | |

(Continued)

FOREIGN PATENT DOCUMENTS

DE 449 117 9/1927

(Continued)

*Primary Examiner* — Jill E Culler
(74) *Attorney, Agent, or Firm* — Jones, Tullar & Cooper, P.C.

(57) ABSTRACT

A cylinder, which is part of an inking system or of a dampening system, has a rotary individual drive which is embodied as a drive motor. A changeable drive is also provided. The rotary drive is driven by the drive motors by a bevel or angular gear.

11 Claims, 14 Drawing Sheets

U.S. PATENT DOCUMENTS

| | | | | |
|---|---|---|---|---|
| 6,644,184 | B1 | 11/2003 | Hajek et al. | |
| 6,779,446 | B2 | 8/2004 | Hajek et al. | |
| 7,370,578 | B2 * | 5/2008 | Bachmeir | 101/351.3 |
| 2004/0000242 | A1 | 1/2004 | Simeth | |
| 2004/0107849 | A1 * | 6/2004 | Christel et al. | 101/247 |
| 2004/0139870 | A1 | 7/2004 | Masuch | |

FOREIGN PATENT DOCUMENTS

| | | |
|---|---|---|
| DE | 1 243 695 | 10/1964 |
| DE | 1 241 841 | 11/1967 |
| DE | 29 32 105 | 2/1981 |
| DE | 38 04 204 | 8/1989 |
| DE | 83 13 742.4 | 2/1990 |
| DE | 38 25 517 | 9/1990 |
| DE | 44 30 693 | 3/1996 |
| DE | 197 50 960 | 6/1998 |
| DE | 197 20 954 | 12/1998 |
| DE | 197 32 059 | 1/1999 |
| DE | 101 03 842 | 10/2001 |
| DE | 196 03 765 | 1/2003 |
| DE | 202 07 179 | 1/2003 |
| DE | 44 35 986 | 6/2003 |
| DE | 101 57 243 | 6/2003 |
| EP | 0 234 456 | 9/1987 |
| EP | 0 387 485 | 1/1990 |
| WO | WO 86/02319 | 4/1986 |
| WO | WO 03/039872 | 5/2003 |

* cited by examiner

CYLINDER OF AN INKING OR DAMPENING SYSTEM

CROSS-REFERENCE TO RELATED APPLICATIONS

This patent application is the U.S. national phase, under 35 U.S.C. 371, of PCT/EP2004/051378, filed Jul. 7, 2004; published as WO 2005/007410 A2 and A3 on Jan. 27, 2005, and claiming priority to DE 103 31 595.0, filed Jul. 11, 2003, and to DE 103 52 614.5, filed Nov. 11, 2003, the disclosures of which are expressly incorporated herein by reference herein.

FIELD OF THE INVENTION

The present invention is directed to a roller of an inking or a dampening system. The roller is axially movable by use of a traversing gear and has an individual drive motor for rotational motion of the roller.

BACKGROUND OF THE INVENTION

DE 197 20 954 A1 discloses a printing group with a vibrator inking system having three distribution cylinders, and a dampening system having one distribution cylinder. The ink flow takes place starting at a distribution cylinder of the inking system which is remote from the cylinder, via an inking roller which is parallel to two distribution cylinders located closer to the transfer cylinder, and from there, via assigned application rollers, to the transfer cylinder. The three-roller dampening system is always in active contact with one of the inking system distributors, so that a dampening agent/ink emulsion is applied to the forme cylinder of the printing group.

A film inking system having three distribution cylinders is known from DE 197 50 960 A1. The ink flow takes place from a distribution cylinder that is remote from the cylinder to a second distribution cylinder, and from there, via parallel application rollers, to the forme cylinder and to the third distribution cylinder, from which smoothing of the ink application takes place via further application rollers.

A film inking system is represented in DE 101 03 842 A1. An angle between a metering gap and a film gap, as well as an angle between the film gap and a press gap lies between 70° and 110°, and in particular lies at approximately 90°.

DE 29 32 105 A1 shows a printing group with a vibrator inking system and a dampening system. The dampening system is movably arranged in such a way that in one operating mode it acts as a three-roller dampening system, wherein no connection with the inking system exists. In the other operating mode, the dampening distribution cylinder has contact with an application roller of the inking system.

A film inking system is known from DE 38 04 204 A1. In addition to a zoned metering of the ink flow arranged in one area of the ink fountain, it is possible to take ink from the inking system, via an intermediate roller and a doctor blade arrangement, for variable regulation or for cleaning purposes.

A distribution cylinder of a printing press is disclosed in DE 101 57 243 A1. A rotatory drive mechanism is arranged on one end. A traversing drive mechanism is located on the other end, such as, for example, on the driven side. Rotatory driving is provided by the motor, either axially directly, or via a pinion gear to a spur wheel of the cylinder.

Transfer rollers of an inking system are seated on spring-loaded support levers in DE 38 04 204 A1.

SUMMARY OF THE INVENTION

The object of the present invention is directed to providing rollers of an inking or dampening system, as well as an inking or dampening system with two rollers, which act together in the print-on position.

In accordance with the present invention, this object is attained by the provision of a roller of an inking or dampening system, which roller is axially movable by a traversing gear. An individual drive motor is used for accomplishing rotational driving of the roller. The roller is movable in a direction perpendicular to its axis of rotation. The roller's drive motor is movable together with the roller. Alternatively, a coupling can be provided between the drive motor, which is fixed, and the roller body which is axially shiftable. Two rollers can work together in a print-on position.

In an advantageous embodiment of the present invention, the ink from the first distribution cylinder reaches the forme cylinder selectively or simultaneously over different possible paths, either in series or in parallel, via two further distribution cylinders. Because of this, the inking system can be very flexibly changed to accommodate printing conditions with different requirements. The same applies to the printing group, in view of the selective assignment of a distribution cylinder to the dampening system, or to the inking system, as well as the possibility of a selection between "purely" direct dampening, and indirect dampening, wherein ink and dampening agent have already been mixed on a distribution cylinder.

An embodiment of the present invention is also advantageous in which rotatory driving of the dampening distributor by its own motor, and in particular by the use of a corner gear, takes place. For simplifying the drive train, in regard to bringing it in and out of contact, the motor is also advantageously co-located on a lever.

By an advantageous arrangement of levers of two cooperating rollers, an embodiment of the present invention is provided which is simple to adjust, but nevertheless in which the two rollers maintain their relative position to each other when being displaced.

In an advantageous embodiment of the invention, for an ideal ink flow through the printing group, ink is taken from the inking system in a specific way, and for example as a function of a printing image and/or a web width. In this way, no oversaturation of non-removed ink occurs, in particular in the edge areas.

BRIEF DESCRIPTION OF THE DRAWINGS

Preferred embodiments of the present invention are represented in the drawings and will be described in greater detail in what follows.

Shown are in:

FIG. 1, a schematic side elevation view of a printing press, in

FIG. 2, a schematic top plan representation of webs of different width, in

FIG. 3, a schematic side elevation view of a printing unit, in

FIG. 4, a depiction of a mode of operation of an inking system, in

FIG. 5, a depiction of a mode of operation of a dampening system, in

FIG. 6, a depiction of a surface structure of a film roller, in

FIG. 7, a perspective view of a take-off device, in

FIG. 8, a view of a device for feeding ink into the inking system, in

DESCRIPTION OF PREFERRED EMBODIMENTS

Figure 1:
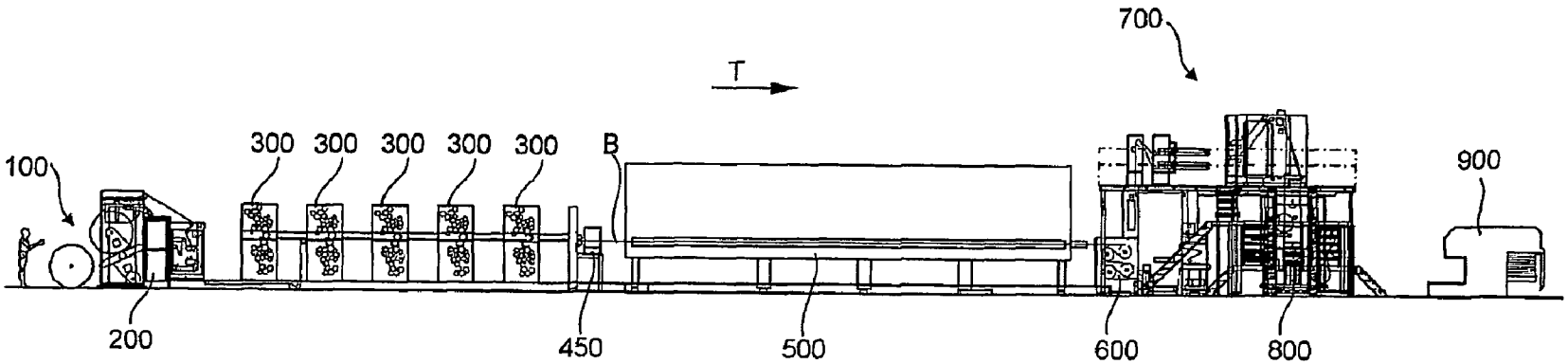

A printing press, and in particular a web-fed rotary printing press for use in imprinting one or several webs B, has, as seen in FIG. 1, several units 100, 200, 300, 400, 500, 600, 700, 800, 900 for provisioning, imprinting and further processing the web or webs. For example, the web B to be imprinted, which, in particular, is a paper web B, is wound off a roll unwinding device 100 before it is supplied via a draw-in unit 200 to one or to several printing units 300. In addition to the printing units 300, which are standardized for multi-color printing, for example by using four of them for four-color printing, it is possible to provide further printing units 300, which, in this case, can be utilized in alternation with one or with several of the remaining printing units being out of service for flying printing forme changes.

In an advantageous embodiment, a varnishing unit 450 can be provided in the web path.

Following imprinting and, if required, varnishing, the web B passes through a dryer 500 and is possibly cooled again in a cooling unit 600, if drying is performed thermally. A further conditioning unit such as, for example, a coating device and/or a re-moistening device, which is not specifically represented in FIG. 1, can be provided downstream of the dryer 500 in, or downstream of the cooling unit 600. Following cooling and/or conditioning, the web B can be supplied via a superstructure 700 to a folding apparatus 800. The superstructure 700 has at least one silicon unit, one longitudinal cutter and turning device, as well as a hopper unit, which is also not specifically represented in FIG. 1. The silicon unit can also be arranged upstream of the superstructure 700, for example in the area of the cooling unit 600. Furthermore, the superstructure can have, a perforating unit, a gluing unit, a numbering unit and/or a plow folder, all of which are not represented in FIG. 1. After passage through the superstructure 700, the web B, or partial webs, are conducted into a folding apparatus 800.

In an advantageous embodiment, the printing press also has a separate transverse cutter 900, such as, for example, a so-called piano delivery device 900, in which a web B which, for example, had not been conducted through the folding apparatus 800, is cut into standard sheets and, if desired, is stacked or delivered.

Figure 2:
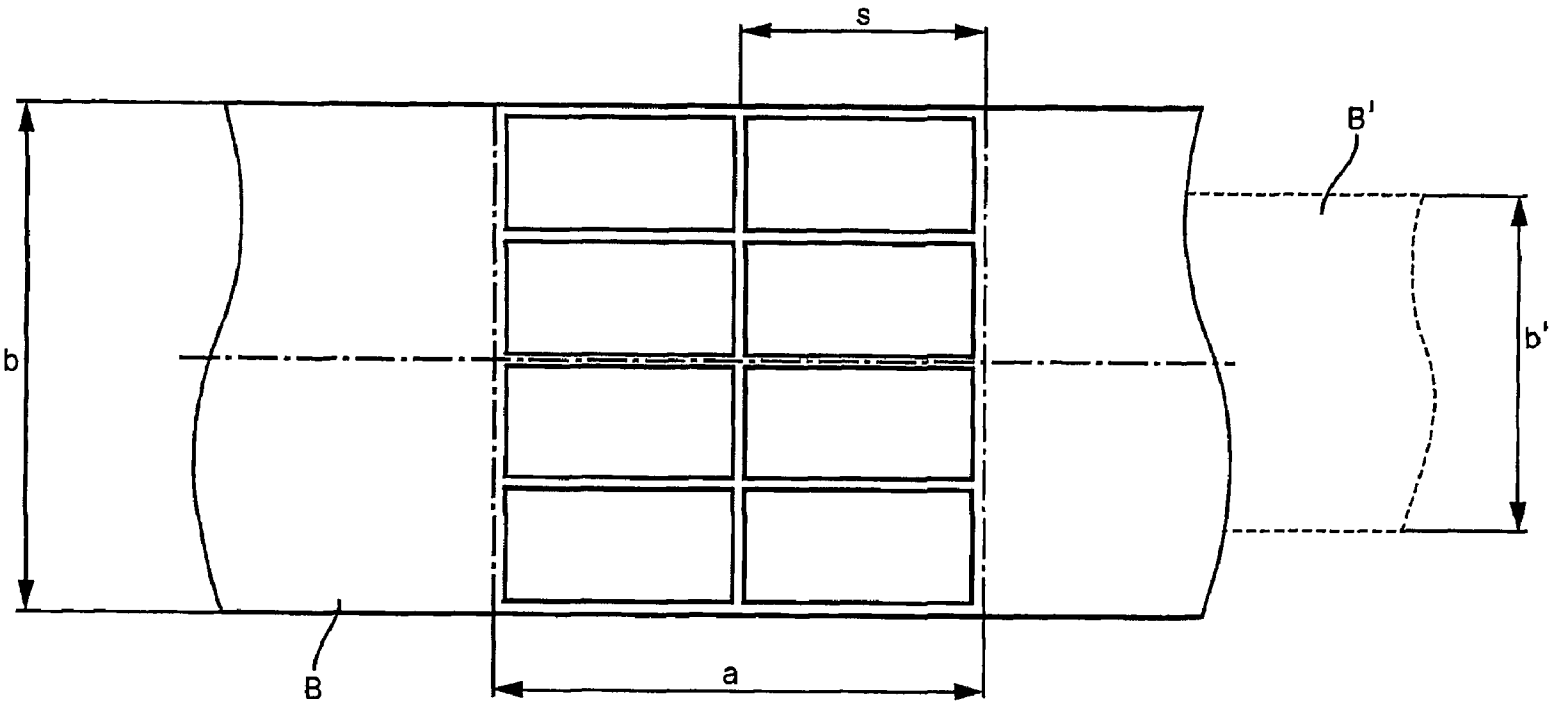

The units 100, 200, 300, 400, 450, 500, 600, 700, 800, 900 of the printing press have an effective width transversely, in respect to a transport direction T of the web B, which effective width permits processing of webs B of a maximum width "b", as seen in FIG. 2, of, for example, up to 1,000 mm. The effective width is understood to be the respective width, or the clear width, of the structural components, such as, for example, the width of the rollers, cylinders, passages, sensor devices, actuating paths, etc. of the units 100, 200, 300, 400, 450, 500, 600, 700, 800, 900, which work together with the web B, either directly or indirectly, so that the web B can be processed, conditioned and conveyed in its full width "b". The functionality, such as material supply, web transportation, sensor devices, further processing devices of the units 100, 200, 300, 400, 450, 500, 600, 700, 800, 900 is configured in such a way that webs B' of only partial width down to a width "b'" of only 400 mm can be processed in the printing press.

The units 100, 200, 300, 400, 450, 500, 600, 700, 800, 900 which define, or process, a section length "a" of web B are configured in such a way that they define, for example, a section "a" of a length of between 540 and 700 mm on the web B. The section length "a" advantageously lies between 540 and 630 mm. In a special embodiment of the invention, the section length "a" lies at 620±10 mm. In a further development of the printing press, the units 100, 200, 300, 400, 450, 500, 600, 700, 800, 900 are configured in such a way that, with a few changes, the printing press can be selectively configured with section lengths of 546 mm, 578 mm or 620 mm. Thus, for example, substantially only an exchange capability of bearing elements for printing group cylinders, a matching of the drive mechanism, as well as matching in the folding apparatus 800 or the transverse cutter 900, all as discussed subsequently, are required for accomplishing the change in order to equip the same printing press for formats which differ from each other. For example, in a standard way, the section length "a" is covered by four vertical printed pages, for example DIN A4, positioned side-by-side in the transverse direction of the web B, and two printed pages, for example of a length s, one behind the other in the longitudinal direction. However, depending on the print image and on the subsequent further processing in the superstructure 700 and in the folding apparatus 800, other numbers of pages per section length "a" are also possible.

Figure 3:
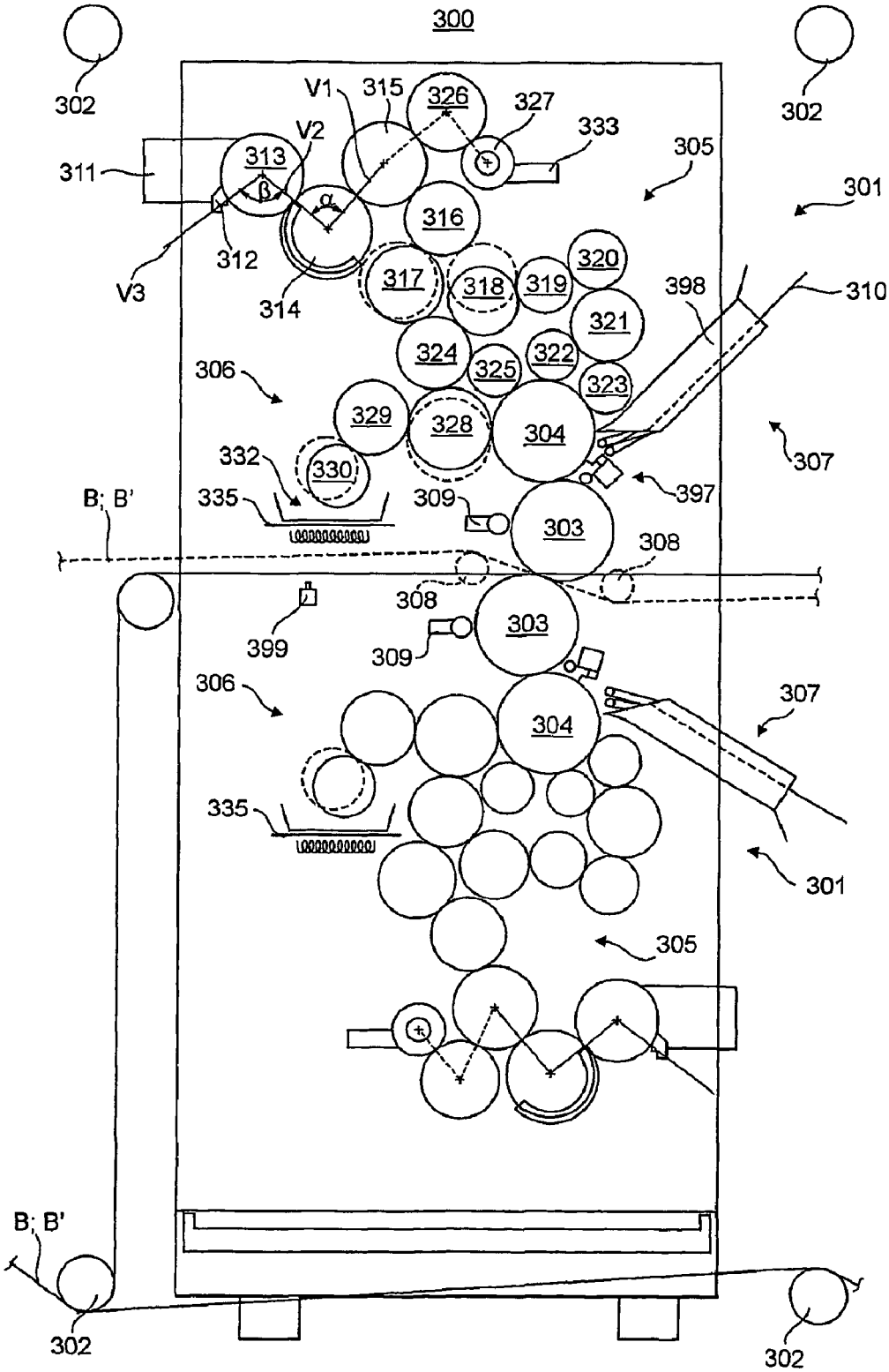

For multi-color imprinting of the web B, B', the printing press has several, such as, for example, at least four, and here in particular five identically equipped printing units 300. The printing units 300 are preferably arranged one next to the other, and a web B, B' passes horizontally through them, as seen in FIG. 1. Each printing unit 300 is preferably configured as a printing unit 300 for offset printing, and in particular is configured as a double printing group 300, or as an I-printing group 300, with two printing groups 301, such as, for example, two offset printing groups 301, as seen in FIG. 3, for accomplishing two-sided printing by the so-called rubber-against-rubber process. Rollers 302 are arranged upstream and downstream at least in the lower area, and optionally in the upper area, of at least one of the printing units 300, by the use of which roller 302 an incoming web B, B' can be conducted around, above or below the printing unit 300, or a web B, B', which has been conducted around an upstream located printing unit 300, can be passed through the printing unit 300, or a web B, B' which has been passed through the printing unit 300 can be conducted around the downstream located printing unit 300.

FIG. 3 schematically shows an arrangement of two printing groups 301 which are working together via the web B, B', each with a pair of printing cylinders 303, 304 embodied as a transfer cylinder 303 and a forme cylinder 304, hereinafter cylinders 303, 304 for short, an inking system 305 and a dampening system 306. In an advantageous embodiment, at the forme cylinder 304, the printing unit 300 has devices 307 for semi- or for fully-automatic plate feeding, or for changing of a printing forme 310.

In a further embodiment, in particular if the printing press is intended to be suitable for imprinting operations, at least one or several of the printing units 300 have additional guide elements situated closely ahead of, and closely behind the nip point of the printing unit 300. If a web B, B' is to pass without being imprinted and without contact between the transfer cylinders 303, the web guidance, accomplished with the use of the guide elements 308, shown in dashed lines in FIG. 3, is advantageous. The web B, B' passes through the nip point in such a way that it substantially forms an angle of between 80° and 100°, and preferably of approximately 90°, with a connecting line joining the axes of rotation of the two transfer cylinders 303. Preferably, the guide elements 308 are provided as rods or as rollers, around which air flows. This reduces the danger of previously freshly applied ink rubbing off.

In a further development of the represented printing group 301, a washing device 309 is assigned to each transfer cylinder 303. The elastic surface of the transfer cylinder 303 can be cleaned by use of the washing device 309.

Each of the cylinders 303, 304 has a circumference between 540 and 700 mm. The forme and the transfer cylinder 303, 304 preferably have the same circumference. In an advantageous manner, the circumferences lie between 540 and 630 mm. In a special embodiment, the section length "a" lies at 620±10 mm. In a further development, the printing unit 300 is structured in such a way that, with a few changes, the cylinders 303, 304 can be selectively provided with circumferences of 546 mm, 578 mm or 620 mm. Thus, for example, substantially only an exchange of bearing elements or a changed position of the bores in the lateral frame, and the lug for the cylinders 303, 304, and a matching of the drive mechanism or lever takes place, as discussed subsequently.

The transfer cylinder 303 has a least one dressing on its circumference, which is not specifically represented, and which is held in at least one groove extending axially on the transfer cylinder shell face. Preferably, the transfer cylinder 303 only has one dressing extending over its effective length, or substantially over the entire width of the web B, B' to be imprinted, and substantially extending, except for a joint of a groove opening, around the entire circumference of the transfer cylinder 303. Preferably, the dressing is configured as a so-called metal printing blanket, which has an elastic layer, such as, for example, of rubber, on a substantially dimensionally stable support layer, for example a thin metal plate. The ends of this dressing are inserted through an opening in the shell face of the transfer cylinder into the groove and are held there by frictional or by positive contact. In the case of a metal printing blanket, the ends are bent/beveled off, for example, in the area of its leading end by approximately 45°, and in the area of its trailing end by approximately 135°. These ends extend through an opening of a groove extending over the entire usable length of the transfer cylinder 303, which groove also has, for example, an arresting, clamping or tensioning device. The opening to the groove, in the area of the shell face, preferably has a width between 1 and 5 mm, and in particular, has a width of less than or equal to 3 mm, in the circumferential direction of the cylinder 304. The clamping device is advantageously embodied to be pneumatically operable, and may be, for example, in the form of one or of several pneumatically operable levers, which levers, in the closed state, are pre-tensed by a spring force against the trailing end extending into the groove. A hose, which can be charged with a pressure medium, can preferably be employed as an operating device.

In addition to an ink feeding device, such as, for example, an ink fountain 311 with an actuating device 312, for use regulating the ink flow, the inking system 305 has a plurality of rollers 313 to 325. The ink feeding device can also be configured as a doctor blade crosspiece. With the rollers 313 to 325 placed against each other, the ink moves from the ink fountain 311 via the duct roller 313, the film roller 314, and a first inking roller 315, to a first distribution roller 316. Depending on the mode of operation of the inking system 305, as will be discussed below, from there, the ink moves via at least one additional inking roller 317 to 320 to at least one further distribution roller 321, 324, and from there, via at least one application roller 322, 323, 325, to the surface of the forme cylinder 304. In an advantageous embodiment, the ink moves from the first distribution cylinder 316 over several possible paths selectively or simultaneously, either in series or in parallel, via two further distribution cylinders 321, 324 to the application rollers 322, 323, 325.

As shown in dashed lines in FIG. 3 for the second inking roller 317, that second inking roller 317 can be brought into a first position, shown in solid lines, in which it takes the ink from the first distribution roller 316 and conducts it via the second distribution roller 324, and at least the second application roller 325, to the forme cylinder 304. In principle, this path is independent of the to be described paths of the ink from the first distribution roller 316, or from the second distribution roller 324, via the third inking roller 318 and a third distribution roller 321, to the forme cylinder 304. In a second position of the second inking roller 317, which is shown in dashed lines, the second inking roller 317 has been moved away from the downstream located second distribution cylinder 324, and the path of the ink over the second distribution roller 324 is interrupted. In an advantageous embodiment of the inking and dampening systems 305, 306, the second distribution roller 324 can simultaneously work together with a roller 328, such as, for example, a fourth application roller 328, of the dampening system 306. Fluid, such as ink and/or dampening agent on the second distribution roller 324, then can, with the rollers 324, 325, 326, as well as the cylinder 304 appropriately being brought into contact with each other, be simultaneously delivered via the application rollers 325 and 328 to the forme cylinder 304.

The third inking roller 318 can also advantageously be brought into two positions. In a first position, shown in solid line, the third inking roller 318 takes the ink off the second distribution roller 324, which receives the ink from the first distribution roller 316 via the second inking roller 317, which is in its first position. The ink is conducted from the third inking roller 318, possibly via further inking rollers 319, 320, to a third distribution roller 321, and from there via at least one distribution roller 322, 323 to the forme cylinder 304. In a second position, which is shown in dashed lines, of the third inking roller 318, the ink is taken directly from the first distribution roller 316. This second position of the third inking roller 318 is of importance in particular when the second inking roller 317 is in its second, dashed lines, position.

If needed, it is possible, by use of the movable second inking roller 317, to interrupt a first ink path via two distribution rollers 316, 324 between the first and the second distribution rollers 316, 324.

It is therefore possible, by the use of the movable third inking roller 318, to realize a direct ink path via two distribution rollers 316, 321 which are arranged in series, or via three distribution rollers 316, 321, 324 which are arranged in series, the first regardless of whether or not the above mentioned first ink path via the second distribution roller 324 has been realized in addition to, and parallel with this path.

The forme cylinder 304 is supplied with ink via a first, front application path from the second distribution roller 324 via one, or possibly via two application rollers 325, 328, and via a second application path, located in the rear, from the second distribution roller 324 via one or several assigned application rollers 322, 323. The expression "front" and "located in the rear" application path refers to the sequence of the contact when the forme cylinder 304 rotates after conveying ink to the transfer cylinder 303.

As represented by dashed lines in FIG. 3, the movable third inking roller 318 can be brought into a first position or placement, shown in dashed lines, in which it takes ink from the first distribution roller 316 and conveys it via the fourth ink roller 319, and the fifth ink roller 320 to the third distribution roller 321. In a second position or placement, the third ink roller 318 takes the ink from the second distribution roller 324, which receives the ink from the first distribution roller 316, via the second inking roller 317. By use of the movable third inking roller 318, it is therefore possible to realize a direct path of ink via two or three distribution cylinders 316, 321, 324 arranged in series, regardless of whether or not, in addition and in parallel to this path, a second path of the ink via only two distribution rollers 316, 324 has been realized.

The inking behavior of the forme cylinder 304 can be changed and set by the inking system 305 via the movable third inking roller 318. In the first mode of operation, in which the roller 318 is in the first position, as shown in dashed lines in FIG. 3, more ink is transferred into the application path "located in the rear" via the second group of rollers 319, 320, 321, 322, consisting of the third distribution roller 321 and assigned ink and application rollers 319, 320, 322, 323, and from there to the forme cylinder 304, than in the second operating mode in which the roller 318 is in its second position. In the second operating mode, ink for the rear application path is first taken from the second distribution roller cylinder 324. Correspondingly, in the reverse way, the ink application is reduced or is increased via the first group of rollers 324, 325, and possibly 328, from the direction of the second distribution roller 324 to the forme cylinder 304.

The rollers or the distribution cylinders which are assigned to the inking system 305 or to the dampening system 306 are understood to be those rollers or distribution cylinders, which, with the inking and dampening systems operated separately, are assigned with their basic function, i.e. in this example a distribution roller 329 in the dampening system 306, and three distribution rollers 316, 321, 324, in the inking system 305 when dampening agent application and ink application are separated.

As also indicated by dashed lines in FIG. 3, the fourth ink application roller 328 preferably can also be shifted between two operating positions. In a first position, which is shown in a solid line, roller 328 is placed against the second distribution roller 324, and in a second position, which is shown in dashed lines, it is moved away from second distribution roller 324. In this case, the contact can be provided from the fourth ink application roller 328 of the dampening system 306 to the second distribution roller 324 of the inking system 305, where an ink/dampening agent emulsion is formed. However, in both positions the fourth ink application roller 328 works together with forme cylinder 304, and with a further distribution roller 329 of the dampening system 306, for example a distribution roller 329, in particular a traversing chromium roller 329. The traversing chromium roller 329 receives the dampening agent from a moistening arrangement, such as, for example, a roller 330, and in particular a dipping roller 330, which dips into a dampening agent supply 332, such as, for example, a water fountain. A drip pan 335 is preferably arranged underneath the water fountain for catching condensation water forming on the water fountain which, in an advantageous embodiment, is configured to be heatable, for example by the use of a heating spiral.

The mobility of the rollers 317, 318, 328 is to be understood as not to be the customary setting capability for adjustment purposes, but instead is meant to be the operational mobility for resetting from one operating position into the other. This means that actuating members and/or stops, such as, for example, adjustable ones, which can be operated manually or by drive mechanisms, are provided for the one, as well as for the other operating position. Furthermore, there is a longer permissible actuating path, or the roller arrangement has been correspondingly selected in such a way that the two positions can be reached over the customary actuating path.

In an advantageous embodiment, the chromium roller 329 and the dipping roller 330 are each seated, for example on levers, so that they can be moved in a direction perpendicular to their respective axes, so that the position of the fourth application roller 328 can be changed in the above mentioned way.

The distribution rollers 316, 321, 324 of the inking system 305, as well as the distribution roller 329 of the dampening system 306 are seated, axially movable, in lateral frames, which are not represented in FIG. 3, in such a way that they can perform a traversing movement. The traversing movement of the distribution rollers 316, 321, 324 and of the distribution roller 329 takes place in a forced manner, coupled via appropriate gears with the respective rotatory drive mechanism. A seating which permits traversing is also provided for the fourth application roller 328 and for the third application roller 323. However, in contrast to the first mentioned distribution rollers 316, 321, 324 and the dampening system distribution roller 329, the axial movement of the application rollers 328 and 323 is merely caused by mechanical friction of the shell faces working together, and not by the use of an appropriate traversing gear. Such seating, which makes possible degrees of freedom in the axial direction, can also be provided optionally for the two application rollers 322 and 325.

The arrangement in the inking and dampening systems 305, 306, shown in solid lines in FIG. 3, represents the working together of the rollers 313 to 325 and 328 to 330 provided for during "normal" printing operations. Ink and dampening paths are also connected by the second distribution roller 324, besides via the forme cylinder 304. Indirect dampening also takes place, in addition to direct dampening.

Figure 4:
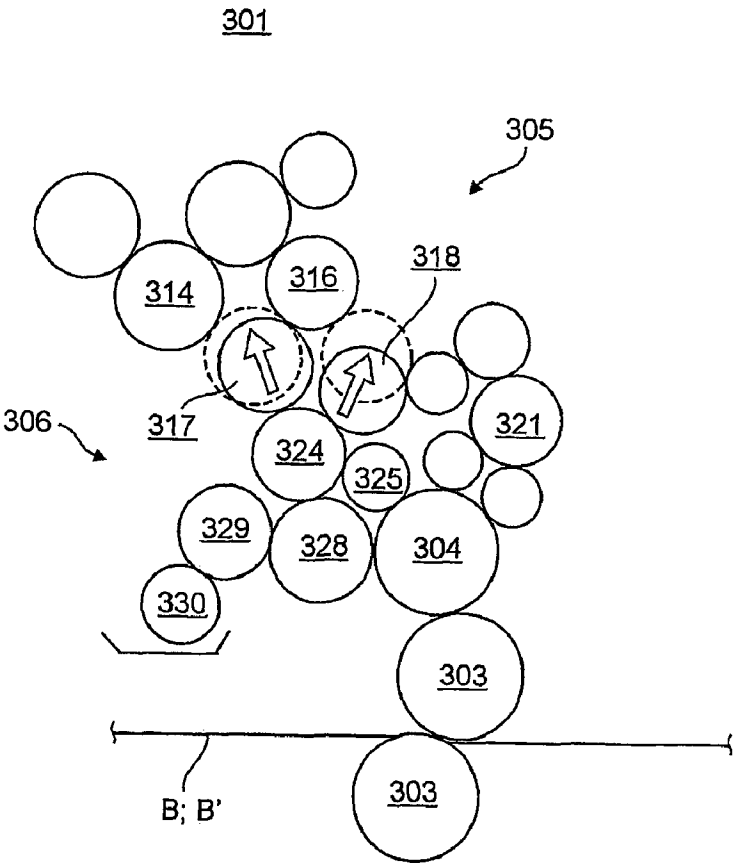

A mode of operations is schematically represented in FIG. 4, for only the upper printing group 301, wherein the second inking roller 317, moved away from the second distribution roller 324, as shown in dashed lines, remains placed against the first distribution roller 316, which is shown in solid lines, and, in a further development, is simultaneously placed against the film roller 314. At the same time, the movable third inking roller 318 is moved away from the second distribution roller 324 and is placed against the first distribution roller 316. Thus, the ink path runs via the first and third distribution rollers 316, 321. The fourth application roller 328 of the dampening system 306 is in contact with the third distribution roller 324, so that the application of dampening agent takes place directly and via five rollers 324, 325 and 328 to 330, thereby forming a five roller dampening system. Because of the displacement capability of the second inking roller 317, and possibly also of the third inking roller 318, one of three distribution rollers 316, 321, 324 of the inking system 305, and an application roller 325 can therefore be assigned to the dampening system 306. This mode of operation of the inking and dampening systems 305, 306 is particularly suited when operating with special inks, and in particular with inks with a large metallic proportion, and/or if no indirect dampening is to take place for other reasons, such as, for example, emulsification behavior and/or unnecessary roller soiling.

Figure 5:
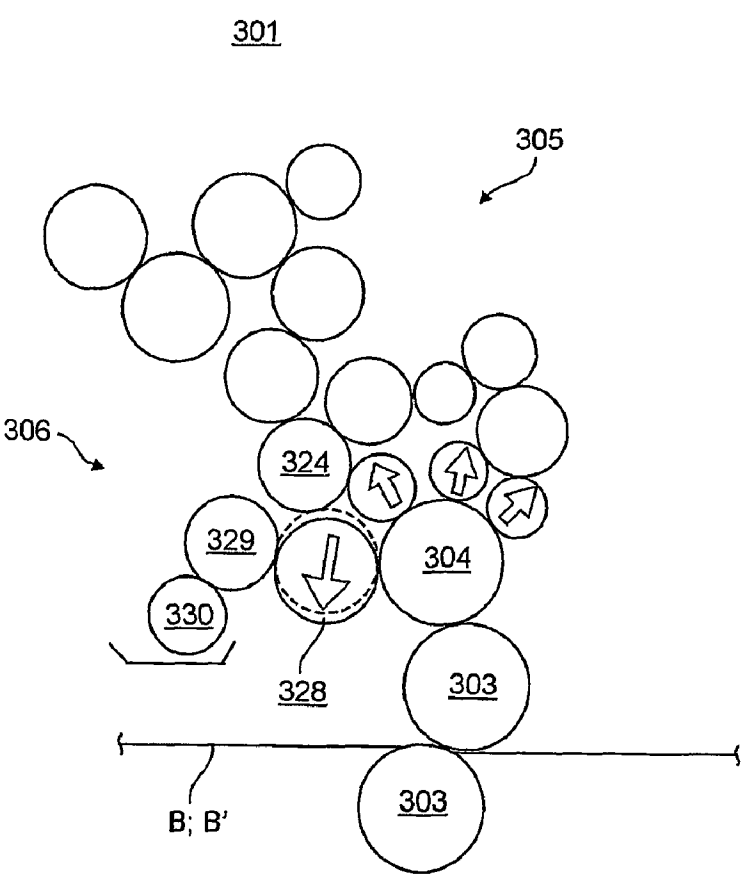

FIG. 5 schematically shows, again only for the upper printing group 301, a mode of operation in which the fourth application roller 328 has been moved away from the second distribution roller 324, as shown in solid lines, but remains placed against the dampening system distribution roller 329, as well as the forme cylinder 304. Dampening takes place only via the three rollers 328 to 330. In a variation, which is not specifically represented, inking can take place simultaneously via all rollers 322, 323, 325 of the inking system 305, with the application rollers 322, 323, 325 in contact. In the variation shown in FIG. 5, however, the application rollers 322, 323, 325 are simultaneously moved away from the forme cylinder 304, as indicated by arrows, and the drive mechanism of the inking system 305 is, for example, decoupled or is stopped. This last mentioned variation of the present invention is particularly suited for the mode of operation of the inking and dampening system 305, 306 in connection with a so-called blind plate operation, which is when the assigned forme cylinder 304, or its printing forme, does not contain an image to be imprinted. Thus, because of the capability of the fourth application roller 328 to be displaced, a selection between direct dampening in the "three roller dampening system" and, as a function of the position of the second inking roller 317, indirect dampening, or direct dampening in the "five roller dampening system" is possible.

In an advantageous embodiment of the inking system 305, the rollers 313, 314, 315, which have been placed against each other, are arranged in such a way that, in the contacted position, connections V1, V2 of the axes of rotation of the rollers 313 and 315, as seen in FIG. 2, substantially form a right angle $\alpha$ of approximately 90° with the respective axis of rotation of the roller 314, i.e. $80° < \alpha < 100°$, in particular $85° < \alpha < 95°$. In an advantageous further development, a connection V3 between the contact point, for example the contact point of the actuating device 312 at the roller 313, also substantially forms a right angle $\beta$ with the axis of rotation of the roller 313, i.e. $80° < \beta < 100°$, in particular $85° < \beta$ 95°, for connecting the axes of rotation of the rollers 313 and 314. The angles $\alpha$ and $\beta$ are oriented in such a way that the three mentioned imagined connections V1, V2 and V3 together result in a "zigzag pattern". This arrangement is of particular advantage in view of the decoupling of undesired movements when producing radial forces, and in view of the reduction of soiling resulting from ink mist.

In an advantageous embodiment of the present invention, the arrangement of the rollers 313 and 314 has been selected to be such that the axis of rotation of the roller 314, which is configured as a film roller 314, lies above the axis of rotation of the duct roller 313. Generally expressed, the arrangement has been selected in such a way that, when taking the direction of rotation of the rollers 313, 314 into consideration, the inlet side of the nip point is located lower than the outlet side. A hydrostatic wedge between the two rollers 313, 314 on the inlet side of the nip point is prevented, which hydrostatic wedge could push the rollers 313, 314 apart and could result in an uneven ink distribution.

Figure 6:
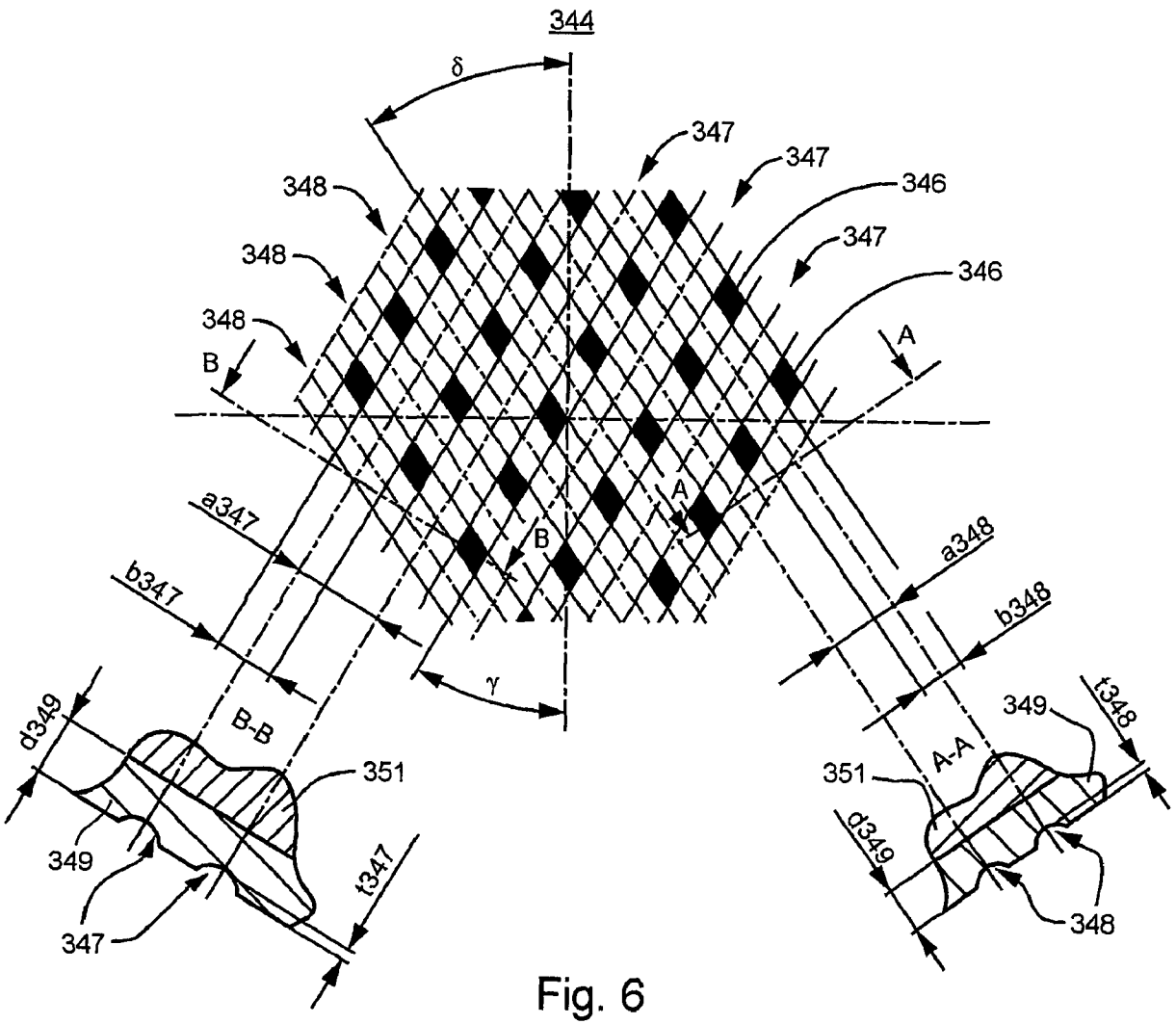

The shell face of the film roller 314 is provided, in a particularly advantageous way, with a surface structure 344, which, as seen in FIG. 6, only has an averaged supporting surface 346, for example elevations 346, between 5 and 15%, and in particular between 5 to 11%, in the effective area, and recesses 347, 348 lying between them. The portion of the supporting surface 346 of the entire effective shell face can, in principle, be embodied in the most diverse manner by evenly distributed recesses, milled-out places, and the like of different patterns. FIG. 6 schematically shows a particularly advantageous configuration of the surface structure 344, which can be produced in a simple manner and moreover which has an advantageous effect with regard to the taking up and releasing of ink.

The surface structure 344 of the film roller 314 consists of two groups of grooves 347, 348 extending in straight lines on the surface of the roller 314. The grooves 347, 348 of each sub-group of grooves extend parallel, with respect to each other, and are evenly distributed over the circumferential surface of the film roller 314. The grooves 347 of the first sub-group of grooves extend at a twist angle $\gamma$, which, for example, lies in the range of between 20° and 40°, and in particular between 25° and 35°, distributed relative to the longitudinal axis of the film roller 314 over the circumferential surface of the film roller 314. The grooves 348 of the second sub-group of grooves extend at a twist angle $\delta$, which, for example lies in the range of between 25° and 35°, and in particular lie between 28° and 38°, in relation to the longitudinal axis of the film roller 314. The grooves 347, 348 of the two sub-groups of grooves are arranged in such a way that they cross on the circumferential surface. The lozenge-shaped elevations 346 are formed between the grooves 347, 348 by the grooves 347, 348 crossing each other.

A depth t347, t348 of the grooves 347, 348 is advantageously from 0.2 to 0.6 mm, at least at their lowest point, wherein the depths t347, t348 of the two grooves 347, 348 are preferably substantially identical. A width b347 of the grooves 347 advantageously is from 1.0 to 1.8 mm, a width b348 of the grooves 348 is advantageously from 0.7 to 1.6 mm. The grooves 347, 348 extending parallel with each other should be spaced apart from each other in such a way that the lateral length of the lozenge-shaped elevations 346 on the one, longer side, such as, for example, adjoining the groove 348 are from 0.5 to 1.0 mm, and on the other, shorter side, such as, for example, adjoining the groove 347 are from 0.4 to 0.7 mm.

In an advantageous embodiment, the production of the grooves 347, 348 takes place by the removal of surface material 349, such as, for example by milling. Advantageously, the grooves have a cross section substantially in the shape of an arc of a circle. This section of an arc of a circle of the wider grooves 347 has a radius, for example, in the range between approximately 0.6 to 1.0 mm, and a radius of the narrower grooves 348 of between 0.4 and 0.8 mm. Milling-out the grooves 347, which are extending spirally on the shell face, takes place, for example, at a distance a347 between the groove center lines of 1.85 to 2.45 mm, while milling-out the grooves 348 takes place, for example, at a distance a348 between the center lines of 1.35 to 1.95 mm. For example, the surface material 349 may be embodied as a plastic material, such as, for example, polyamide, and in particular as a sinter-coated plastic material on a metallic roller base body 351, such as, for example, a metal tube, which is not specifically represented, of a preferred wall thickness of 7.0 to 12 mm. Advantageously, a non-milled thickness d349, i.e. in the area of the elevation 346, of the surface material 349 lies between 0.8 and 1.2 mm.

Besides the above-mentioned rollers 313 to 325, the inking system 305 has at least one further roller 326, by the use of which ink can be taken from the inking system 305 in the ink path, in particular at a location upstream of the first distribution cylinder 316. This takes place wherein an appropriate removal device 333, which is shown in FIG. 3, can be placed against this roller 326 itself or, as is shown in FIG. 3, against a roller 327 working together with it.

Figure 7:
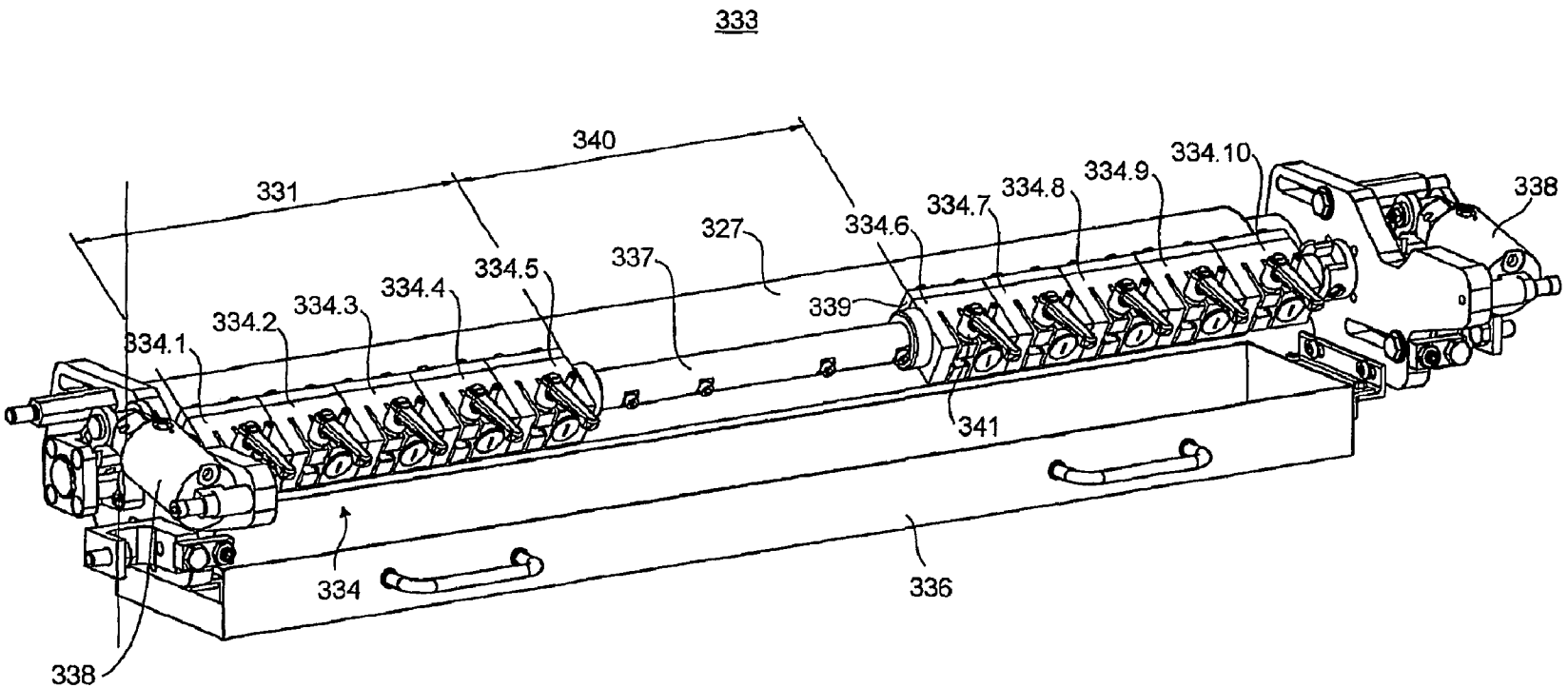

FIG. 7 shows the removal device 333 working together with the roller 327, and possibly also the roller 326, but matched to the specific roller direction of rotation. A plurality of sections 334, for example embodied as stripping elements 334, including for example, individual stripping elements 334.1 to 334.10, can be placed against the shell face. In particular, the removal device 333 has respectively at least one such stripping element 334, at least in an edge area of the roller 327. For example, no stripping elements 334 are provided in the area of a central zone 340, also referred to as a non-effective zone 340, of the roller 327. In a non-represented variation, stripping elements 334 can also be provided in the zone 340 which stripping elements 334, however, are adjusted or set, as required, in such a way that they do not come into contact with the shell face when the removal device is brought into contact. Depending on whether one or several stripping elements 334 are brought in or out of contact, especially in the roller edge area, ink can be taken out of the corresponding section of the roller 327 and can be caught, for example, in a reservoir 336 and can be returned again in a further development of the ink guidance device. This section represents a zone 331, which is effective in respect to ink removal, and in particular represents a contact zone 331. Thus, ink is removed via the roller 327 in this section of the inking roller 315, and therefore is also possibly removed in the subsequent ink path to the forme cylinder 304. Such removal may only be partial because of re-inking. It is therefore possible to set an ink flow in the inking system 305 to a web width "b", "b'" of the web B, B' to be imprinted by setting defined stripping elements 334 from the respective edge section of the roller 327. In the embodiment of FIG. 7, one group of several stripping elements 334, in this case five such stripping elements 334.1 to 334.5, and 334.6 to 334.10, have been arranged side-by-side, substantially ending flush with each other, from the direction of each edge area of the roller 327. It is possible to arrange a section without stripping elements 334, corresponding to a minimum width "b" of a web B' to be imprinted between the two groups.

In the embodiment in accordance with FIG. 7, the stripping elements 334 are arranged on a common spindle 337 and can be brought into and out of contact with roller 327 by pivoting the spindle 337 by the operation of a spindle drive mechanism 338, which, in this case, is a cylinder 338, which can be actuated by pressure media, and which is located on both sides of the stripping element. The definition of the effective stripping elements 334 here is provided by the manual setting of blades 339 via respective actuating mechanisms 341, such as, for example, lever mechanisms 341. However, in an advantageous further development, the setting of the blades 339 can also take place via individual drive mechanisms, such as, for example, by the use of small pressure-medium cylinders, magnetically, piezo-electrically or by motors. In this case, drive mechanisms which are remote-controlled, such as, for example, from a control console and/or a press control device, are advantageous.

In an embodiment which is not specifically represented, the stripping elements 334 are not brought into or out of contact as a whole. Instead, setting takes place individually for each stripping element 334, for example by the use of individual drive mechanisms, such as, for example, by the use of small pressure medium cylinders, magnetically, piezo-electrically or by motors. Here, too, remote-controlled drive mechanisms are advantageous, which may be operated, for example, from a control console and/or from a press control device.

Figure 8:
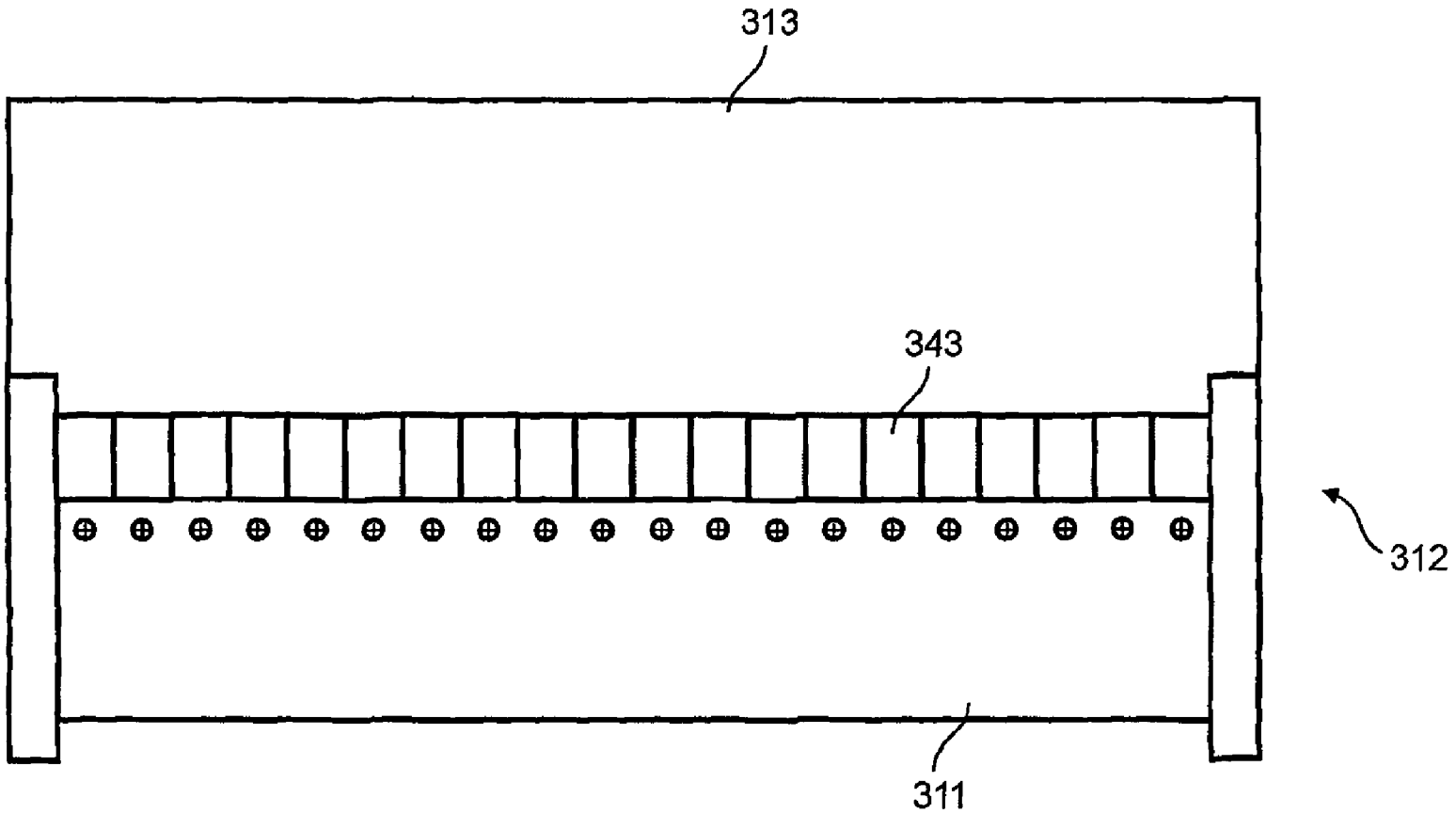

In connection with the variation, or embodiment, with remote-controlled drive mechanisms, a way of proceeding, which is described in what follows, is of advantage. When setting the ink flow for the product and/or the width "b", "b" of the web B, B' to be imprinted, the ink inflow from the ink fountain 311 into the inking system 305 is performed in zones by setting flow-through gaps between the ink fountain 311 and the first roller 313, as shown schematically in FIG. 8. This takes place, for example, in a remote-controlled manner by adjusting ink blades 343 by the use of drive mechanisms, which are not specifically represented in FIG. 8. If a center-running web B', which is of only partial width "b" is imprinted, in principle at least one of the ink blades 343 on each side of the roller 313 is closed, for example. The number of ink blades 343 which basically must be closed as a result of the web width is determined by the width b, b' of the web B, B'. Moreover, ink blades can, of course, also be closed as a function of the print image, or as a function of the ink requirement in the respective zones of the area to be imprinted.

In an advantageous embodiment of the present invention, the basic setting, as a function of the width of the web B, B', is performed automatically by the press control device, as a function of the web width to be imprinted. For example, this web width information is available in the product information and/or in the roll changer 100. The information regarding the web width, or the information regarding closed ink blades 343, is now used for controlling the above-mentioned drive mechanisms for the individually actuatable stripping elements 334 or blades 339. The selection of the stripping elements 334 or blades 339 to be used are determined based on this information, and the respective drive mechanisms are triggered. The control of ink blades 343 on the one side and the blades 339 or stripping elements 334 on the other side can also take place in parallel on the basis of mutually available information, such as, for example, information regarding the web width.

Figure 9:
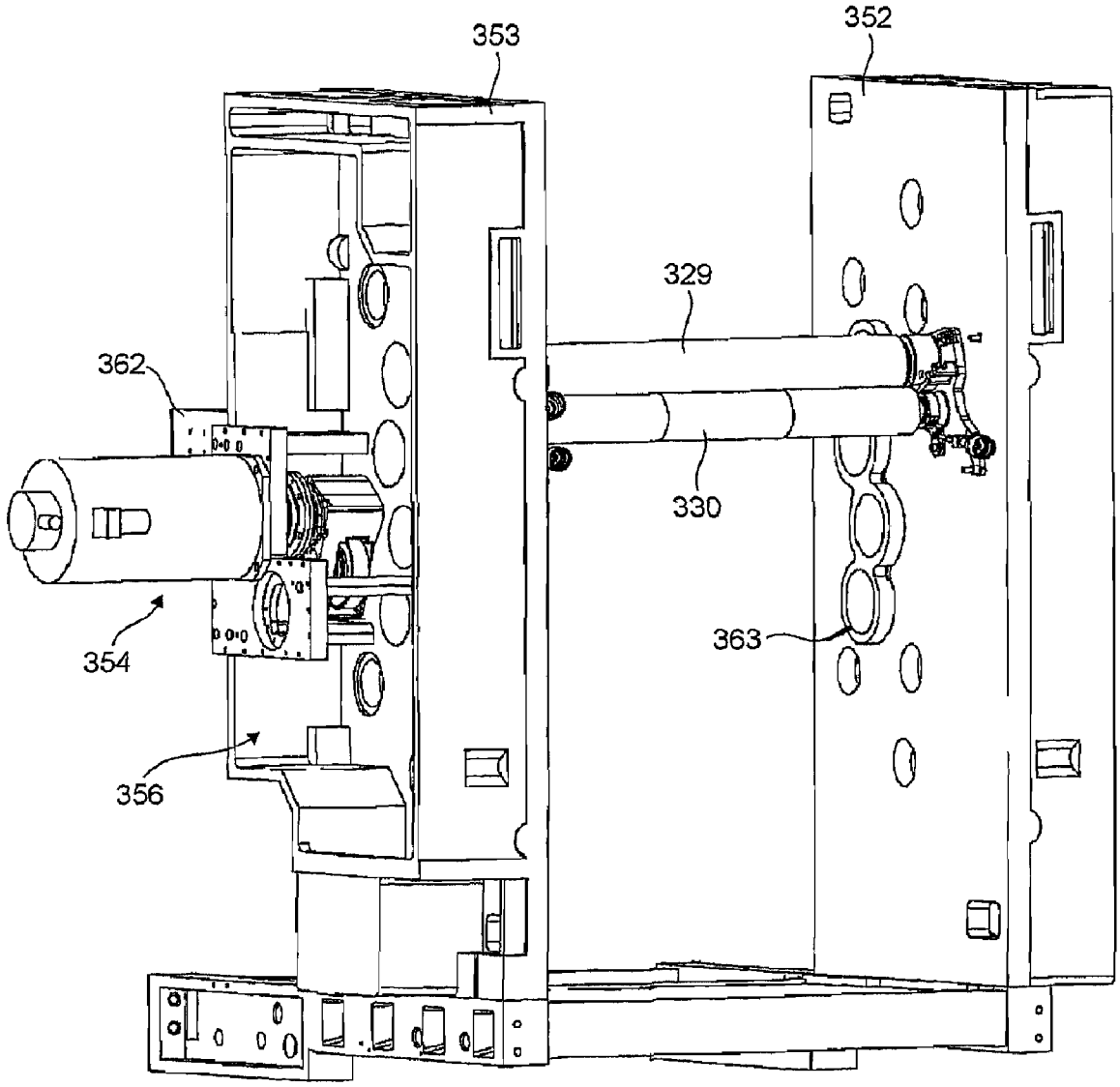
FIG. 9, a perspective view of a frame of the printing unit with a main drive mechanism and dampening system rollers, in FIG. 10, a top plan view on the frame with covers and a lug, in FIG. 11, a side elevation view of a suspension and drive mechanism of dampening system rollers, in FIG. 12, an oblique perspective view of dampening system rollers, in FIG. 13, a side elevation view of a rotatory drive mechanism of an axially movable roller, in FIG. 14, a side elevation view of an axial drive mechanism of a rotatable roller, in FIG. 15, a perspective view of a drive mechanism of the printing group cylinders, and in FIG. 16, a schematic depiction of a drive mechanism of the inking system rollers.

The cylinders 303, 304 and the rollers 313 to 330 of the inking and dampening systems 305, 306 are each seated with their respective ends in, or on lateral frames 352, 353, or frame walls 352, 353, as can be seen in FIG. 9. However, only the rollers 329 and 330 with their fastening and drive simulation, which will be described in greater detail below, as well as the main drive 354 of the printing unit 300, also explained below, are represented by way of example in FIG. 9.

Figure 10:
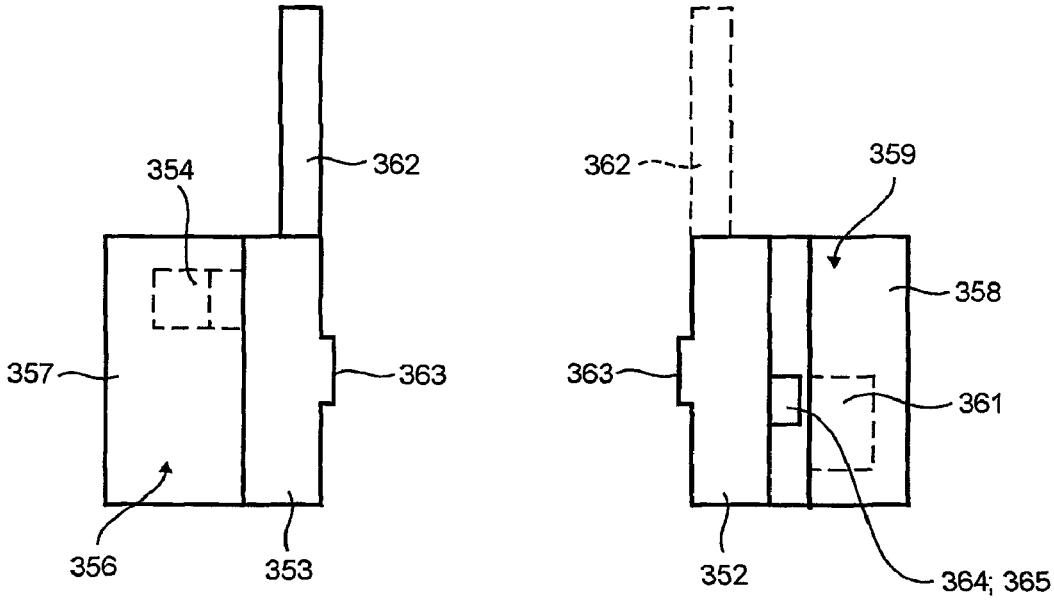

One of the frame walls 352, 353, and in particular the frame wall 353 on the side of the main drive 354, is structured to be in one or in several parts in such a way that a lockable hollow space 356, such as, for example, a lubricant chamber 356, can be formed, which space 356 extends at least over an area which covers the fronts of all of the cylinders 303, 304 and the rotatorily driven rollers. As represented schematically in FIG. 10, a releasable cover 357 for the hollow space 356 is provided at the frame end face. The other frame wall 352, together with a similar releasable cover 358, which is arranged at the cover end face, also forms a hollow space 359, in which the switching and control devices 361, which is shown in dashed lines, for example in the form of a switchgear cabinet 361, among others, of the printing unit 300 are housed. In contrast to an arrangement between the printing units 300, the advantage is provided by the arrangement of the switching and control devices 361 at the frame end face because the space between two printing units 300 is accessible from both sides. Therefore, an operating side of the printing press can be freely selected. This is further aided in that a longitudinal tie-bar 362 connecting the printing units 300 can be selectively arranged on the frame wall 352 or 353.

A longitudinal tie-bar 362 connecting the printing units 300 is arranged on one of the frame walls 352, 353, for example selectively.

On the sides of the frames facing the cylinders 303, 304, the frame walls 352, 353 each have a shoulder 363 extending out of the plane of the respective frame wall 352, 353. Advantageously, the shoulder 363 is embodied to be of one piece with the lateral frame 352, 353 and is advantageously produced, in the course of the production in a casting mold, in the form of a so-called lug 363. The lug 363 has bores extending through it and through the plane of the frame wall 352, 353 for receiving bearings, which are not represented. The lug 363 extends, in particular continuously, over the end area of the forme and transfer cylinders 303, 304, but not over the end areas of the traversing inking or dampening systems and/or of those rollers and cylinders capable of traversing.

Figure 11:
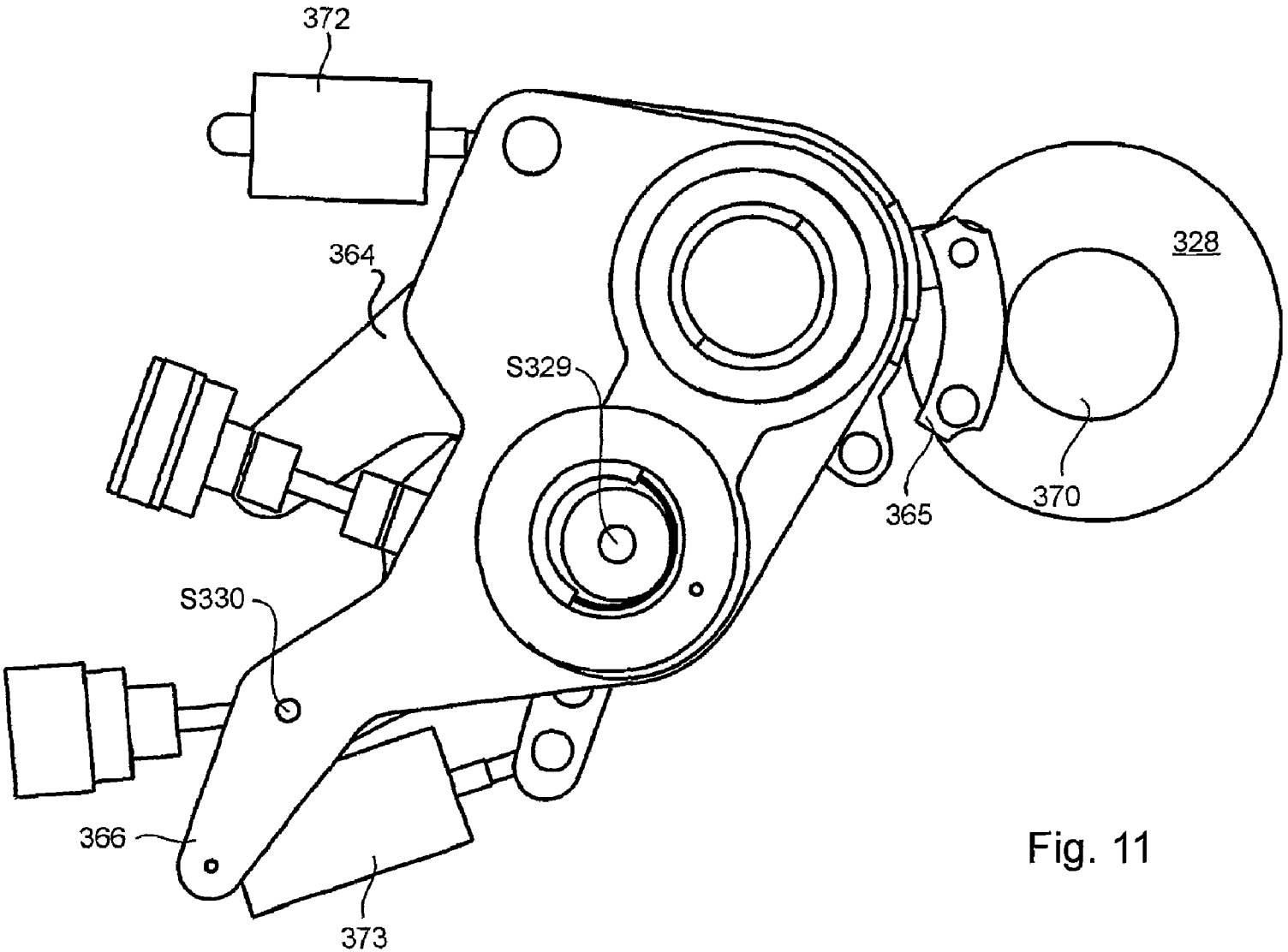

The rollers 329 and 330 depicted schematically in FIG. 9, are seated, on the inside of the frame walls 352, 353, in levers 364, 366, which are each pivotable around a pivot shaft S329, S330, which extends parallel with the respective roller axis of rotation, as seen in FIG. 11. However, they can also be seated in eccentric bushings. Also, one of the rollers 329, 330, and in particular the roller 330, can, for example, be seated in eccentric bushings, and the other roller, and in particular the roller 329, then can be supported in levers 364, 366.

Figure 12:
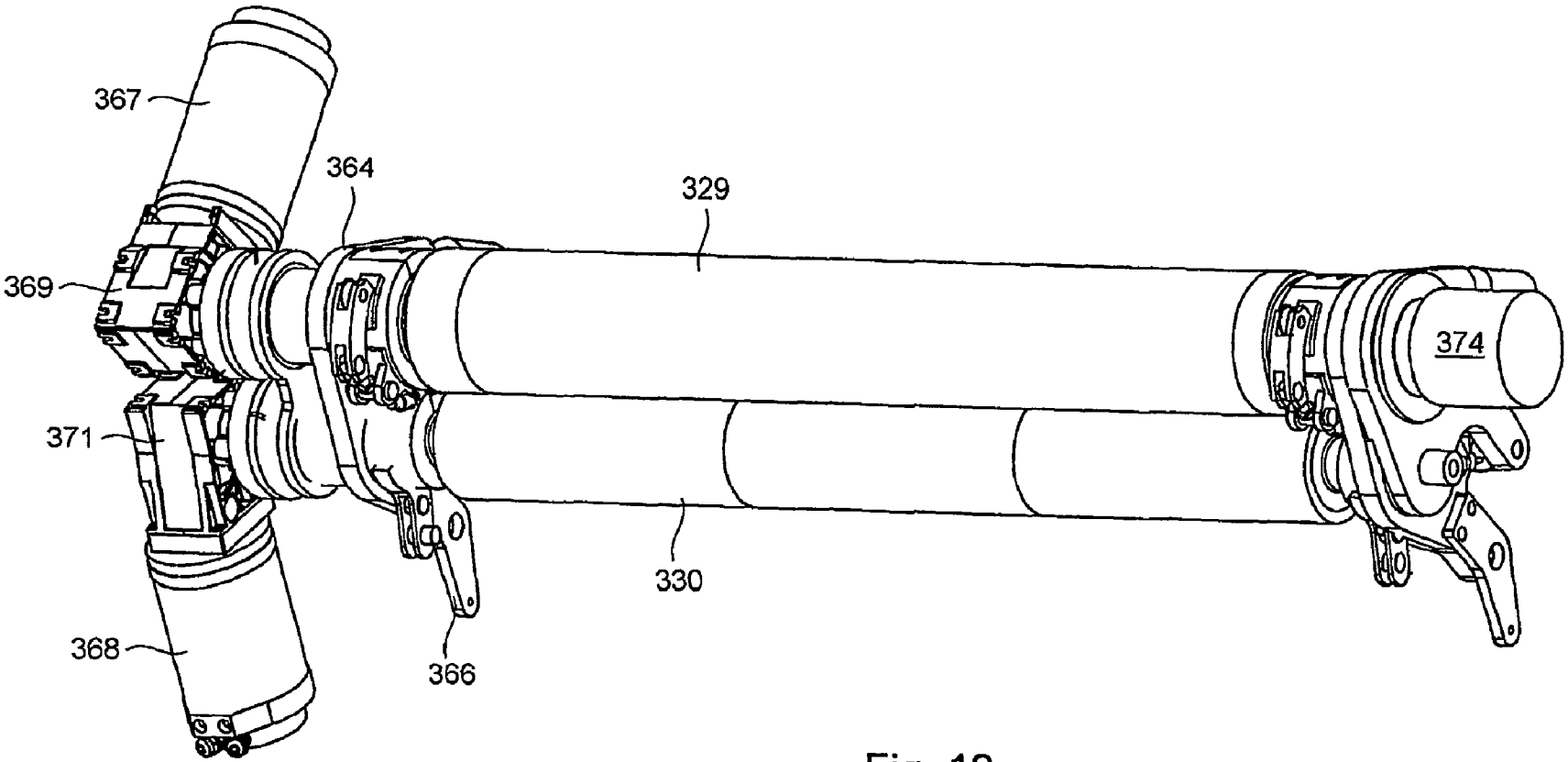

In a preferred embodiment of the present invention, the pivot shaft S329 coincides with the axis of rotation of the roller 330 and is moved, along with the roller 329, in the course of pivoting of the lever 364. The pivot shaft S330 of the roller 330 is fixed in place on the frame. One individual rotatory drive mechanism 367, 368 for each roller 329, 330, and in particular a drive motor 367, 368, is provided for each roller 329, 330, as seen in FIG. 12 and is also connected with the respective lever 364, 366 and is thus moved, along with the respective roller 329, 330, and which thus individually rotatorily drives the respective roller 329, 330, mechanically independently of each other, for example via a corner, bevel or angle gear 369, 371. Drive motor 367, 368 is preferably embodied as an electric motor 367, 368 whose number of revolutions can be regulated, which can, in particular, be regulated continuously, and in particular as a rotary current motor 367, 368. Setting of the number of revolutions, or of the dampening, can take place in an advantageous manner from the control console, such as, for example from the ink setting console, where it is also displaced. In a preferred embodiment, a correlation between the speed of rotation of the press and the dampening, or the number of revolutions, is stored in the press control device, by the use of which, the number of revolutions, to which the two rollers 329, 330 are to be adjusted, and in particular to which the roller 330 is to be adjusted, can be preset.

The lever 366 of the roller 330 can have an adjustable stop 365, by the use of which, the roller 330 is supported in the contact position of the dampening system 306 on a stop 370 of the fourth application roller 328, which works together with the roller 329.

The respective lever 364, 366 can be pivoted by a lever drive mechanism 372, 373, and in particular by cylinders 372, 373 which can each be charged with a pressure medium. The rollers 329, 330 are seated, preferably on both sides, on the two frame walls 352, 353 in respective levers 364, 366, each with drive mechanisms 372, 373 for accomplishing the pivoting movement, as seen in FIG. 11.

Figure 13:
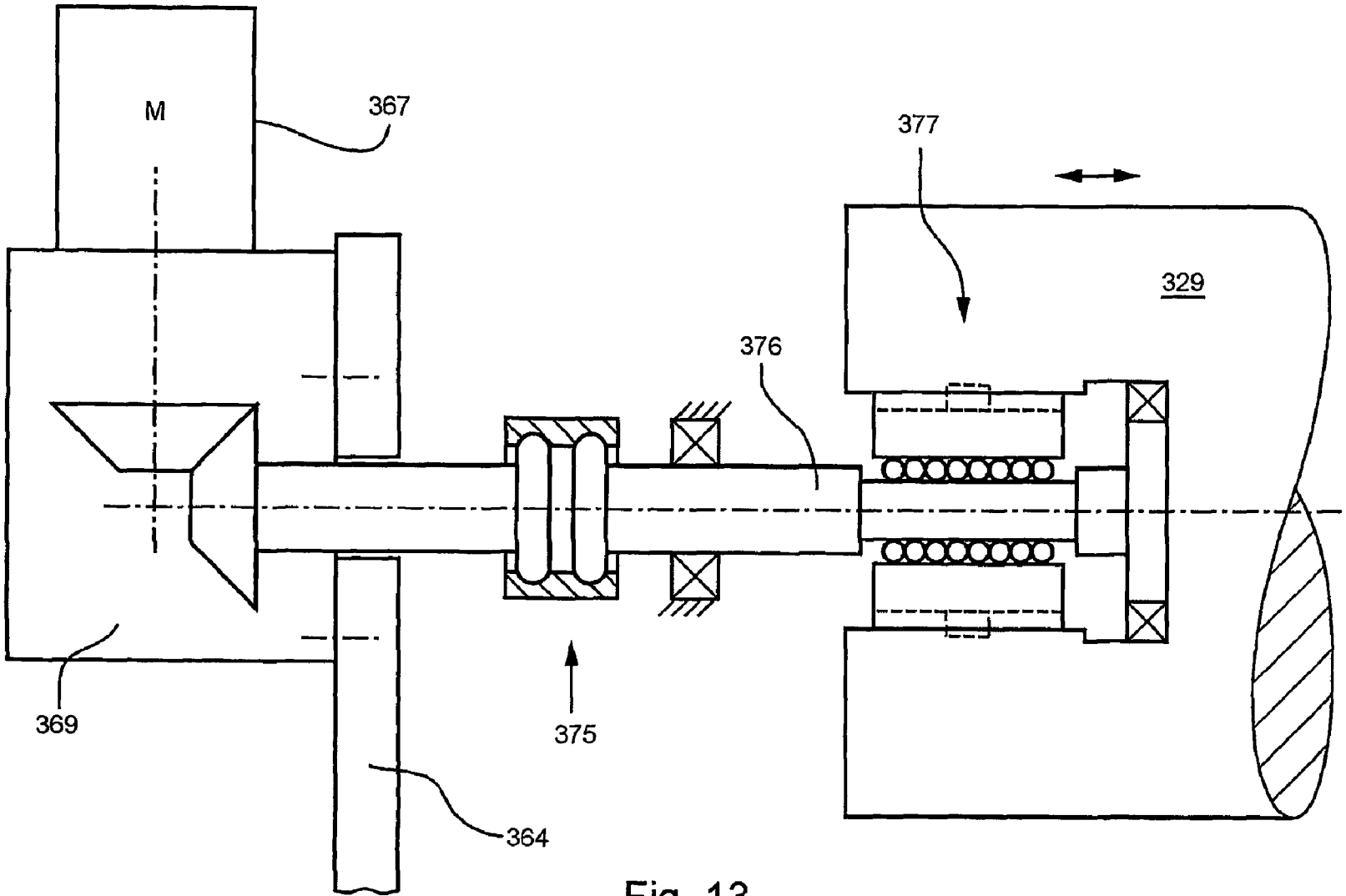

On the front or end of roller 329 that is opposite the rotatory drive mechanism 367, the roller 329 has a traversing drive 374, which, in particular, is a traversing mechanism 374 for generating an axial traversing movement from the roller rotary movement. This traversing mechanism 374 is preferably arranged outside of the roller body in order to avoid generation of heated spots of frictional heat in the roller 329. In an advantageous embodiment, the traversing mechanism 374 is located on the drive side of the printing group 300, i.e. in the area of the same frame wall as the main drive 354, and/or as a drive train of the printing group cylinders. However, the rotatory drive mechanism 367 of the rollers 329 and 330 may be situated on the opposite side, i.e. in the area of the frame wall 352. If the hollow space 356 is embodied as a lubricant chamber 356, the traversing mechanism 374 can be arranged in it as an open gear, which is not separately lubricated. On the side or end of the roller 329 remote from the traversing mechanism 374, the roller 329 is seated in a drive connection with the motor shaft via the corner gear 369 and via an angle-compensating coupling 375, which may be, for example, a hypoid-tooth coupling device, and a shaft 376, via a coupling assembly 377, which may be for example, embodied as a bearing 377, and in particular may be an axial bearing, in such a way that a rotatory movement is transmitted, but an axial movement of the roller 329 in regard to the shaft 376 is also possible, all as seen in FIG. 13. Advantageously, the bearing 377 is embodied as a ball-bearing sleeve, which transmits torque, wherein balls which run, for example, in longitudinal grooves of the shaft 376, as well as of the bearing body, transmit a torque, but keep the bearing body axially movable in relation to the shaft 376. For example, the bearing body may be connected, fixed against relative rotation, with the roller body of the roller 329.

Figure 14:
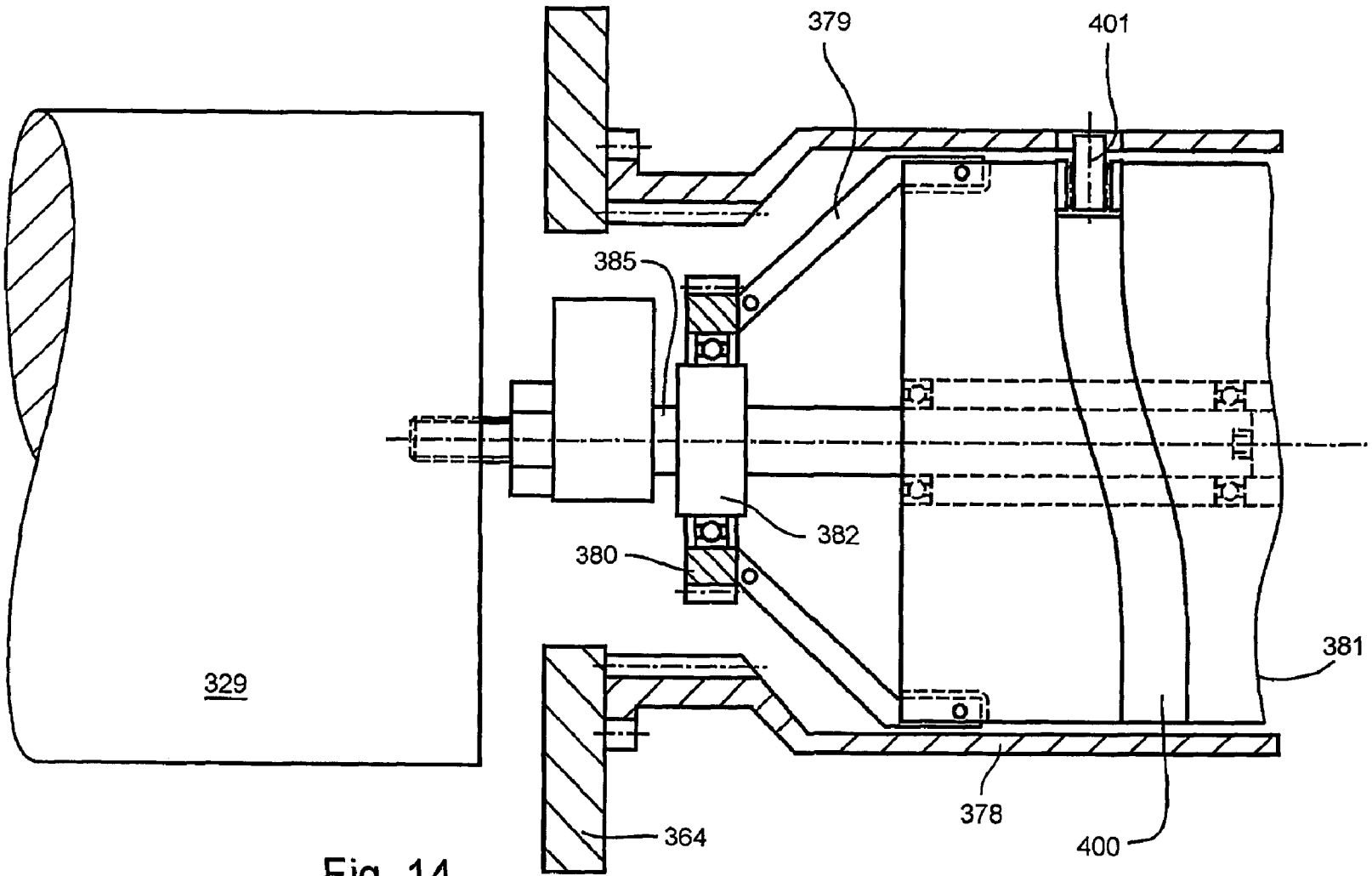

FIG. 14 shows an advantageous embodiment of the gear 374 in the area of the other end face of the roller 329, which gear 374, in principle, is embodied based on the function of a cam gear with a groove 400 extending in a curved shape and an engaging stop 401. An outer sleeve 378, with inner teeth, is fixedly connected with the lever 364 and supports the stop 401, or alternatively the groove 400, with the stop then being on the roller. An inner bushing 381, which supports the groove 400, or alternatively the stop 401, is connected, via a flexible, but torsion-proof connector 379, which may be hinged or having flexural strength, with an annular gear 380 with teeth on its exterior. The annular gear 380 is rotatably seated on an eccentric device 382, which is connected, torsion-proof, but eccentrically with respect to the axis of rotation of the roller 329, via a shaft 385, with the latter. When the roller 329 rotates, the eccentric device 382 rotates and lets the annular gear 380 roll off on the inner teeth, in the course of which the inner bushing 381 is caused to rotate in relation to the outer bushing 378 that is fixed on the lever. A gear reduction ratio between the rotation of the roller 329 and the rotation of the inner bushing 381 is determined by the tooth ratio between the inner teeth and the annular gear 380. The axial movement of the inner bushing, which is caused by the curve of the groove 400, is transmitted, as a traversing movement, to the roller 329 via the connector 379, which can be charged with pressure and tension, a seating between the eccentric device 382 and the annular gear 380, which can be charged with pressure and tension, and the roller 385.

The arrangement of the traversing roller 329 or of the roller 330 in levers 364, 366, the individual rotatory drive via the drive motors 367, 368 assigned to the respective levers 364, 366, possibly via corner gears 369, 371, as well as, in case of the traversing motion, the arrangement of the drive motor 367, 368 and of the traversing gear 374 on the above-described sides of the press, can be transferred in the same way to one or to several others of the rollers of the inking system 305, and should therefore be understood as such.

Figure 15:
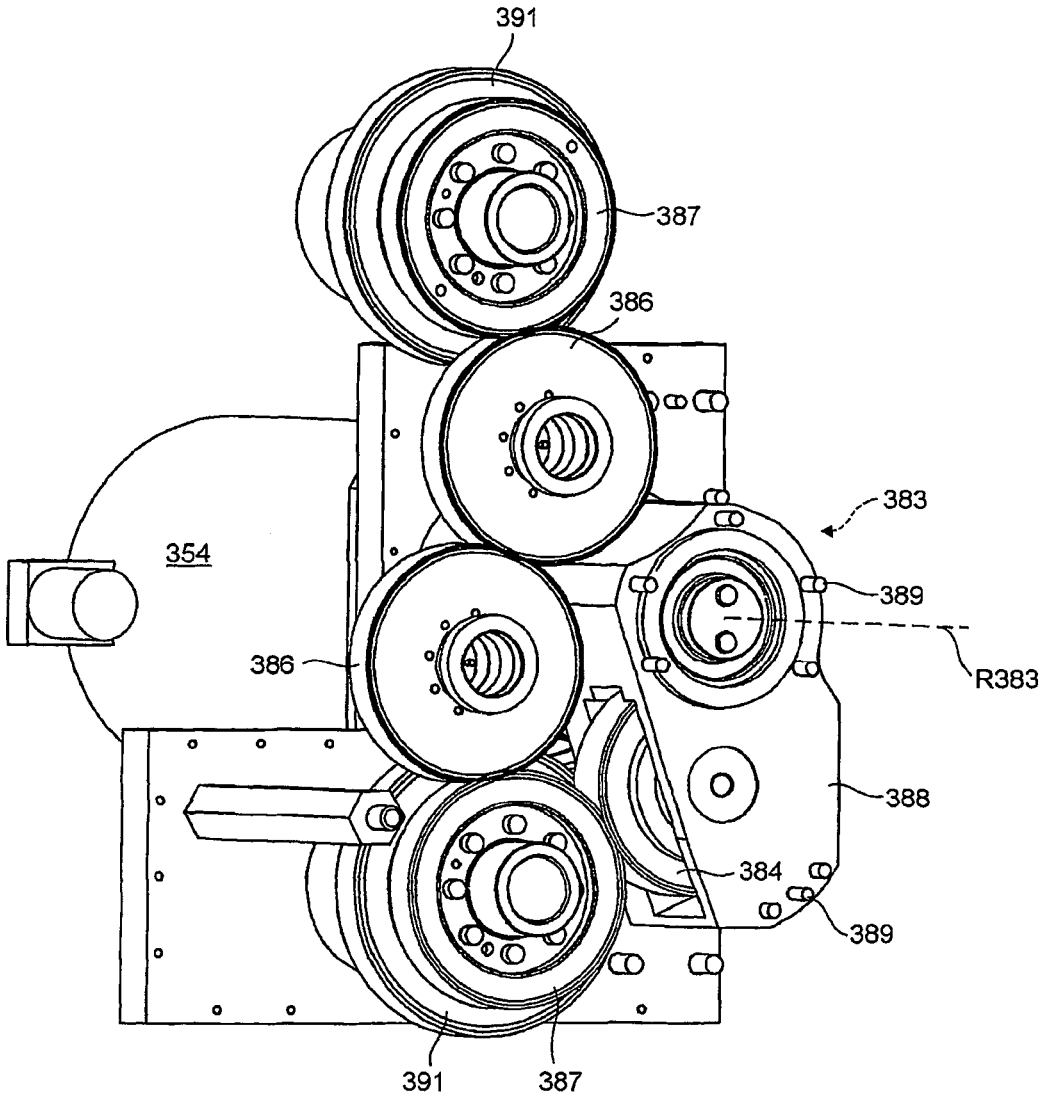

As can be seen in FIG. 9, driving of the cylinders 303, 304 of the printing unit 300 is performed via a main drive 354, such as, for example, an electric motor 354 which is fixed in place on the frame, and in particular by an electric motor 354 whose angular position can be regulated and which electric motor 354 is advantageously embodied to be water-cooled. The arrangement of the drive mechanism is represented in more detail in FIG. 15, starting at the frame wall 353 and viewed toward the outside. With its pinion gear 383 which is indicated by the arrow in dashed lines, but which is not visible in FIG. 15, the electric motor 354 does not drive directly on a drive wheel 386, 387 of one of the cylinders 303, 304, but via an intermediate wheel 384. The intermediate wheel 384 is seated in a lever 388, which lever 388 is seated to be pivotable in principle around an axis of rotation R383 of the pinion gear 383. With the position of the electric motor 354 fixed in place, with respect to the frame wall 353 of the frame, an adaptation of printing units 300 of different formats to different cylinder circumferences, and therefore to different circumferences of the drive wheels 386, 387, can take place in a simple manner. Depending on the format of the printing unit 300, the lever 388 is pivoted during mounting in such a way that the intermediate wheel 384 is in optimal engagement with the respective drive wheel 386 or 387. Fixation elements 389, such as, for example, bolts 389 and corresponding bores, which are not specifically represented, are advantageously provided on the drive unit and/or in the frame wall 353, by the use of which, the aligned lever 388, after having been mounted in the respective position with regard to the frame wall 353 and/or to the electric motor 354, can be fixed in place. The bores that are relevant for the respective format are preferably already prepared during the manufacturing of the structural parts in the factory. In a printing unit 300, or in a printing press, for a first format with a section length "a", the lever 388 is fixed, in respect to a vertical line, in a different position than in a printing unit 300, or in a printing press, for a second format, also with a section length "a", wherein the electric motor 354 maintains its position in respect to the frame wall 353.

In principle, driving can take place from the intermediate wheel 384 on any arbitrary one of the drive wheels 386, 387. However, driving preferably first takes place on the drive wheel 387 of one of the two forme cylinders 304. From there, driving takes place on the drive wheel 386 of the associated transfer cylinder 303. From there, driving occurs on the other transfer cylinder 303, and finally on the second forme cylinder 304. The drive wheels 386, 387 are connected, fixed against relative rotation, for example via journals, with their respective cylinder 303, 304. Rotatory driving of one or several rollers 313 to 327 of the associated inking systems 305 takes place through further drive wheels 391, which are connected, fixed against relative rotation, with the two forme cylinders 304. Advantageously, the distribution cylinders 316, 321, 324 are rotatorily driven, from the direction of the forme cylinder 304, via a positively connected drive mechanism. The duct roller 313 typically has its own rotatory drive mechanism, such as, for example, its own, mechanically independent drive motor, which is not specifically represented. The remaining rollers 313, 315, 317 to 320, 322, 323 and 325 to 327 of the inking system 305 are only rotatorily, and possibly also axially driver, as discussed above, by friction.

Figure 16:
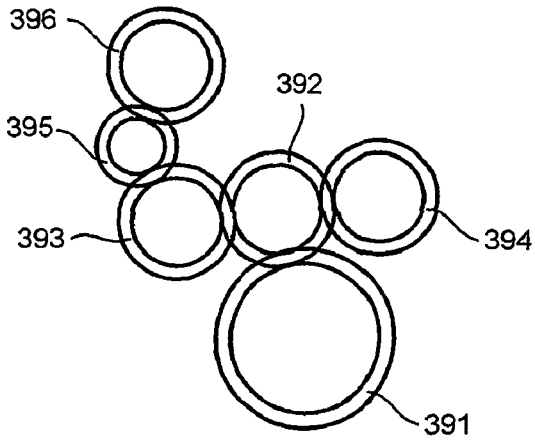

In an advantageous manner, driving of the two distribution cylinders 321, 324 takes place, via an intermediate wheel 392, on drive wheels 393, 394 mounted of the two distribution cylinders 321, 324, as seen in FIG. 16. The intermediate wheel 392 is preferably configured to be either coupled or decoupled, so that the respective drive train and the forme cylinder 304 can be mechanically separated from each other. The similar but non-represented drive train in the lower printing group 301 follows correspondingly. From the drive wheel 393 of the distribution cylinder 324, driving is performed, through a further intermediate wheel 395, on a drive wheel 398 of the distribution cylinder 316. The drive or intermediate wheels 392 to 396 are preferably configured as gear wheels 392 to 396. The drive connections have been structured in such a way that an axial movement of the distribution cylinders 316, 321, 324 is made possible.

As depicted in FIG. 3 and as already mentioned above, in an advantageous embodiment, the printing group 301 utilizes the device 307 for accomplishing the at least semi-automatic changing of a printing forme 310 on the assigned forme cylinder 304. The forme changing device 30 is configured in two parts and has a contact pressure device 397, also called a "semi-automatic changer" 397, which is arranged in the area of a nip point between the forme and transfer cylinders 303, 304, and a magazine 398, structurally separated from it, which magazine 398 is provided with feeding and receiving devices for the printing formes 310.

In an advantageous further development, the printing unit 300 has a device 399 for counter-acting the fan-out effect, i.e. for affecting a change in the transverse extension/width of the web B from one print location to the other, which fan-out effect is caused by the printing process, and in particular is caused by moisture. To this end, at least one nozzle is arranged on a cross-beam in such a way that gas, and in particular air, flowing out of the at least one nozzle is directed onto the web B. B'. Depending on the force of the flow of that gas, the web B, B' undulates more or less when passing through this area, which undulation results in a correction of the width b, b' and of the lateral alignment of each partial area of the printed image.

While preferred embodiments of rollers of an inking or dampening system, as well as an inking or dampening system with two rollers acting together in the print-on position, in accordance with the present invention, have been set forth fully and completely hereinabove, it will be apparent to one of skill in the art that various changes in, for example, the type of web being printed, the specific inks and dampening fluids being used, and the like can be made without departing from the true spirit and scope of the present invention which is accordingly to be limited only by the appended claims.

What is claimed is:

1. A distribution roller for use in at least one of an inking system and a dampening system of an offset rotary printing press comprising:

a roller train defining a fluid stream in said one of said inking system and said dampening system, said fluid stream extending from a supply roller of one of ink in said inking system and of dampening fluid in said dampening system to an application roller engageable with a forme cylinder of said offset rotary printing press, said distribution roller being an axially reciprocating distribution roller in said fluid stream of said roller train and being intermediate said supply roller and said application roller;

a roller body of said distribution roller and having first and second roller body ends;

spaced first and second pivotable levers supporting said first and second ends of said roller body for rotation of said roller body about an axis of rotation of said roller body;

a distribution roller rotary drive mechanism including a rotary drive motor, said distribution roller rotary drive mechanism being located at one of said first and second ends of said roller body on one of said first and second pivotable levers and being usable to rotate said roller body about said axis of rotation of said roller body; and a distribution roller traversing drive mechanism located at the other of said first and second ends of said roller body on the other of said first and second pivotable levers and being usable for traversing said roller body along said axis of rotation of said roller body, each of said roller body first and second ends, said roller traversing drive mechanism and said roller rotary drive mechanism being supported on said first and second pivotable levers for movement of each of said roller body, said roller traversing drive mechanism and said roller rotary drive mechanism in a direction which is perpendicular to said axis of rotation of said roller body.

2. The distribution roller of claim 1 further including a traversing gear in said distribution traversing drive mechanism and wherein said distribution roller rotary drive mechanism is a motor.

3. The distribution roller of claim 1 wherein said roller rotary drive mechanism is fixed in place in an axial direction of said roller and includes a coaxial drive shaft and a coupling, said coupling allowing said traversing movement of said roller body with respect to said coaxial drive shaft of said rotary drive mechanism.

4. The roller of claim 3 wherein said coupling is an angle-compensating coupling.

5. The roller of claim 1 wherein said roller rotary drive mechanism includes a bevel gear.

6. A roller for use in at least one of an inking system and a dampening system of an offset rotary printing press comprising:

a roller train defining a fluid stream in said one of said inking system and said dampening system, said fluid stream extending from a supply roller of one of ink in said inking system and of dampening fluid in said dampening system to an application roller engageable with a forme cylinder of said offset rotary printing press, said roller being an axially reciprocating distribution roller in said fluid stream of said roller train and being intermediate said supply roller and said application roller;

a roller body of said distribution miler and including spaced first and second roller body ends, said roller body being supported for movement perpendicular to an axis of rotation of said roller body;

spaced first and second pivotable levers supporting said first and second roller body ends;

a roller traversing drive mechanism positioned at said first end of said roller body an one of said first and second pivotable levers, said roller traversing drive mechanism being usable to move said roller body in a traversing movement in an axial direction of said axis of rotation of said roller body;

a roller rotary drive mechanism located at said second end of said roller body on the other of said first and second pivotable levers, said roller rotary drive mechanism being usable to rotate said roller body about said axis of rotation of said roller body, said roller rotary drive mechanism and said roller traversing drive mechanism being supported by said first and second pivotable levers and being movable with said roller body in said direction perpendicular to said axis of rotation of said roller body; and a coaxial drive shaft and a coupling in said distribution roller rotary drive mechanism, said drive shaft being fixed in place in said direction of said axis of rotation of said roller body, said coupling being adapted to transmit a torque from said roller rotary drive mechanism to said roller body and to permit said axial traversing movement between said drive shaft and said roller body.

7. The roller of claim 6 wherein said roller rotary drive mechanism includes an independent drive motor.

8. The roller of claim 6 wherein said roller traversing drive mechanism includes a traversing gear adapted to convert rotary movement of said roller into said traversing movement of said roller.

9. The roller of claim 8 wherein said traversing gear is an open, not individually lubricated gear, and further including at least one drive wheel of a printing group cylinder of said printing press, said traversing gear and said at least one drive wheel being located in a lubricant chamber.

10. The roller of claim 8 wherein said traversing gear is a cam gear and further including a reduction gear between said roller and said cam gear.

11. The roller of claim 8 wherein said traversing gear is a cam gear including a rotating gear member and a fixed stop member.

* * * * *